United States Patent [19]

Era et al.

[11] Patent Number: 4,695,178

[45] Date of Patent: Sep. 22, 1987

[54] JOINT FOR REINFORCING BAR EMPLOYED IN CONCRETE CONSTRUCTION

[75] Inventors: Yoshiyuki Era, Chiba; Yasuo Kumagai, Saitama, both of Japan

[73] Assignee: Okabe Co., Ltd., Tokyo, Japan

[21] Appl. No.: 887,719

[22] Filed: Jul. 18, 1986

[30] Foreign Application Priority Data

Jul. 30, 1985 [JP] Japan ..... 60-117080[U]

[51] Int. Cl.[4] ..... B25G 3/00

[52] U.S. Cl. ..... 403/14; 403/374; 403/314

[58] Field of Search ..... 403/314, 393, 390, 374, 403/14

[56] References Cited

U.S. PATENT DOCUMENTS 943,469 12/1909 Schade ..... 403/314

FOREIGN PATENT DOCUMENTS 56-19617 5/1981 Japan .

57-7686 2/1982 Japan .

728691 4/1955 United Kingdom ..... 403/393

*Primary Examiner*—Andrew V. Kundrat

*Attorney, Agent, or Firm*—Wenderoth, Lind & Ponack

[57] ABSTRACT

A joint for reinforcing bars includes a joint main body having a pair of substantially parallel side walls and at least one curved wall which connects together the end edges of both side walls, together and a wedge inserted into wedge bores which are respectively provided in the side walls in such a manner so as to be aligned with each other. The end portion of each of the reinforcing bars which are to be connected together are set in such a manner so as to contact the inside of the curved wall, and the wedge is press-fitted into the wedge bores. Thus the end portion of each reinforcing bar is clamped and thereby rigidly secured between the wedge and the curved wall. The curved portion is formed so as to have a substantially V-shaped inner wall surface including a pair of slanting surfaces. Thus, the end portion of each of the reinforcing bars which is pressed by the wedge is pressed against the pair of slanting surfaces and allowed to bite into the area defined therebetween.

2 Claims, 9 Drawing Figures

JOINT FOR REINFORCING BAR EMPLOYED IN CONCRETE CONSTRUCTION

BACKGROUND OF THE INVENTION

1. Field of the Invention

The present invention relates to a joint for connecting together reinforcing bars employed in concrete construction.

2. Description of the Related Art

A typical conventional joint of the type described above has, as shown in FIG. 9, a sleeve (a) with an oval cross section which serves as a joint main body and a wedge (b). To connect the reinforcing bars (c) and (d) together by using this joint, the respective end portions of the reinforcing bars are inserted into the joint in such a manner that they are respectively fitted into two curved portions of the joint, and the wedge (b) is press-fitted into wedge bores (e) which extend through the respective centers of two side walls of the sleeve (a) so that the end portions of the reinforcing bars (c) and (d) are pressed against the inner surfaces of the corresponding curved portions of the sleeve (a) and thereby rigidly secured between the wedge (b) and said surfaces, thus enabling the joint to resist any axial force applied to these reinforcing bars (c) and (d).

The above-described conventional joint for reinforcing bars employed in concrete construction suffers, however, from the following problems. Since each of the reinforcing bars (c) and (d) and the sleeve (a) are in contact with each other at only one point, the frictional resistance occurring between the reinforcing bars (c), (d) and the sleeve (a) which counteracts the force axially applied to the reinforcing bars (c) and (d) is relatively small, which means that it is undesirably easy for the reinforcing bars (c) and (d) to come out of the sleeve (a).

Although marketed reinforcing bars with a circular cross section are produced so that the outer diameters thereof are within tolerances regulated in accordance with J.I.S. (Japanese Industrial Standard), reinforcing bars which have annular or linear projections provided on the outer surfaces thereof are not subject to J.I.S. standards with respect to the outer diameters thereof, and they are standardized only in terms of the weight per unit length. For this reason, when such reinforcing bars are connected together by employing the conventional joint of the type described above, the clamping force of the joint differs in accordance with the outer diameters of the reinforcing bars employed, which means that it is impossible to effect an accurate and reliable connection.

In addition, the position of the projections provided on the above-described reinforcing bars relative to the inner surface of the sleeve differs in accordance with the circumferential orientation (i.e., orientation about the axis) of the reinforcing bars inserted into the sleeve, and this also inhibits the connection of reinforcing bars in a satisfactory condition.

SUMMARY OF THE INVENTION

In view of the above-described circumstances, it is an object of the present invention to provide a joint which enables reinforcing bars to be connected together with an increased clamping force.

It is another object of the present invention to provide a joint which enables reinforcing bars to be reliably connected together substantially irrespective of the outer diameters of the reinforcing bars which are to be connected and regardless of whether or not projections are provided on the outer surfaces of the reinforcing bars.

To these ends, the present invention provides a joint wherein a curved portion for receiving one end portion of a reinforcing bar is formed so as to have a V-shaped inner surface including a pair of slanting side surfaces, so that the reinforcing bar which is pressed by a wedge is pressed against the slanting side surfaces so as to be rigidly retained thereby.

The above and other objects, features and advantages of the present invention will become clear from the following description of the preferred embodiments thereof, taken in conjunction with the accompanying drawings.

DESCRIPTION OF THE PREFERRED EMBODIMENTS

Figure 1:
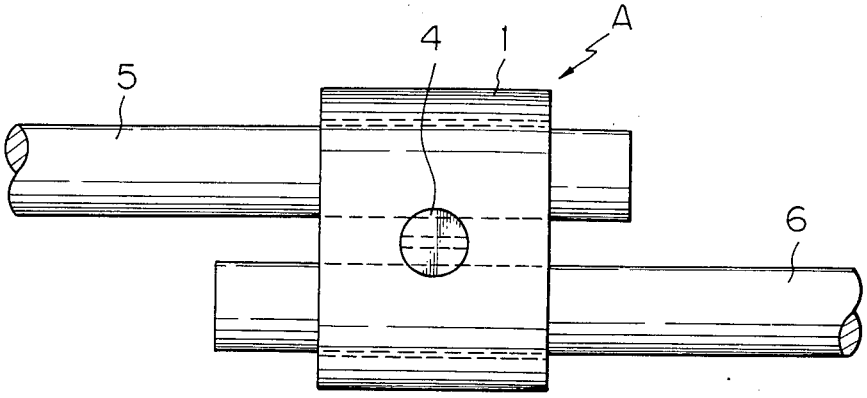
FIG. 1 is a front view of a joint for reinforcing bars employed in concrete construction in accordance with a first embodiment of the present invention.
Figure 2:
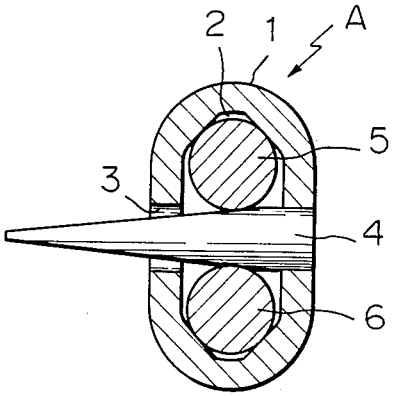
FIG. 2 is a sectional view of the joint shown in FIG. 1.
Figure 3:
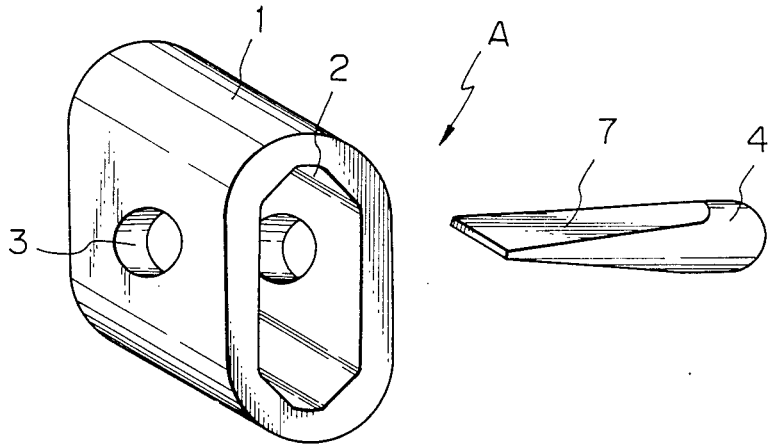
FIG. 3 is an exploded perspective view of the joint shown in FIG. 1.

FIGS. 1 to 3 show in combination a joint in accordance with a first embodiment of the present invention. This joint includes a sleeve 1 which serves as a joint main body. The sleeve 1 is formed from a steel pipe that is subjected to either hot or cold drawing to form a pipe material with an outer periphery having an oval cross section and an inner periphery having any desired cross-sectional configuration, and this material is cut into an appropriate length. Each of the upper and lower curved portions of the sleeve 1 is formed to have a V-shaped inner surface which includes a pair of slanting side surfaces. Wedge bores 3 having a circular cross section are provided in the respective centers of both side walls of the sleeve 1 in such a manner that the wedge bores 3 are aligned with each other. The joint further includes a wedge 4 which is formed from a bar having a circular cross section in such a manner that the proximal end portion of the bar is left as it is but the other forward portion of the bar has upper and lower taper surfaces 7. Reinforcing bars 5 and 6 are bars having a circular cross section.

In operation, as shown in FIG. 1, the connecting end portions of the reinforcing bars 5 and 6 are respectively inserted into the upper and lower curved portions of the sleeve 1 from the opposite sides thereof, and the wedge 4 is press-fitted into the area between the reinforcing bars 5 and 6 from one of the wedge bores 5 to the other. Consequently, the reinforcing bar 3 is pressed against the upper V-shaped inner surface of the sleeve 1, while the reinforcing bar 6 is pressed against the lower V-shaped inner surface, so that each of the reinforcing bars 5 and 6 is brought into pressure-contact with both side surfaces of the corresponding inner surface 2 of the sleeve 1, that is, each reinforcing bar is in two-point contact with the inner surface 2, and the reinforcing bars 5 and 6 bite into the respective V-shaped inner surface 2. Accordingly, these reinforcing bars 5 and 6 are connected together strongly in a satisfactory condition.

Figure 5:
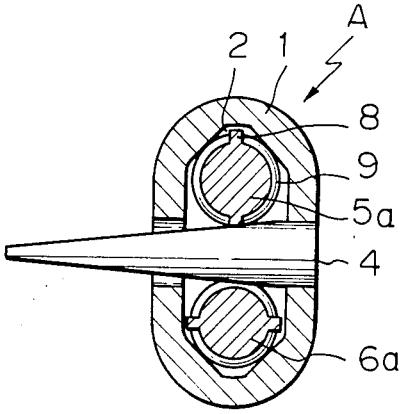
FIG. 5 is a sectional view of the joint shown in FIG. 4.
Figure 4:
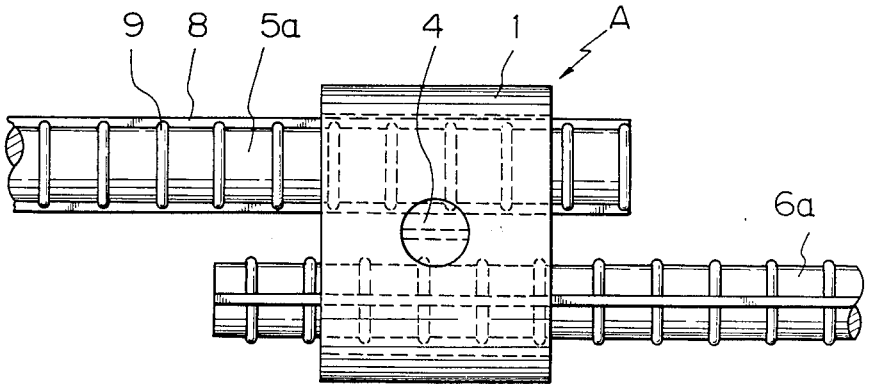
FIG. 4 is a front view of the joint shown in FIG. 1 showing a connection of reinforcing bars that are different from those shown in FIGS. 1 and 2.

FIGS. 4 and 5 show in combination the joint in accordance with the first embodiment used with reinforcing bars 5*a* and 6*a* which are different from the above-described reinforcing bars 5 and 6. Each of the reinforcing bars 5*a* and 6*a* is provided on the outer surface thereof with linear projections 8 which are circumferentially spaced apart from each other and extend in the axial direction of the reinforcing bar and annular projections 9 which are axially spaced apart from each other.

With such reinforcing bars, irrespective of the location of the linear projections 8 of each of the reinforcing bars 5*a* and 6*a* about the axis of the reinforcing bar, each reinforcing bar is brought into pressure-contact with both side surfaces of the upper or lower V-shaped inner surface at two points and each reinforcing bar bites into the V-shaped inner surface in a manner similar to that shown in FIGS. 1 and 2. Thus, the reinforcing bars 5*a* and 6*a* are also reliably connected together in a satisfactory condition.

Figure 6:
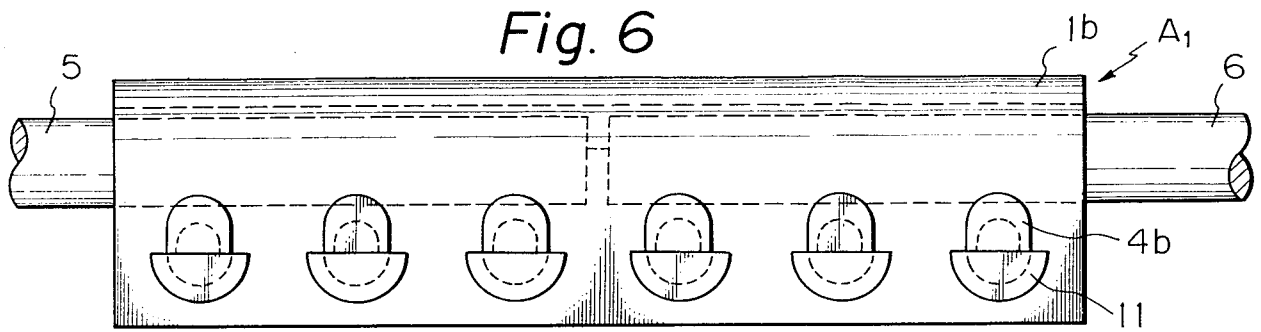
FIG. 6 is a front view of a joint for reinforcing bars employed in concrete construction in accordance with a second embodiment of the present invention.
Figure 9:
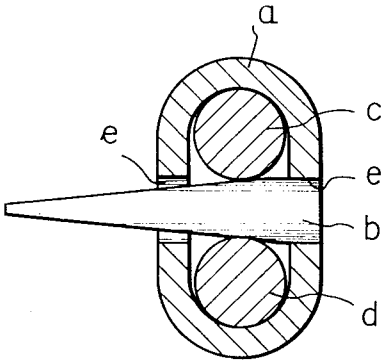
Fig. 9 PRIOR ART
FIG. 9 is a sectional view of a conventional joint for reinforcing bars employed in concrete construction.
Figure 7:
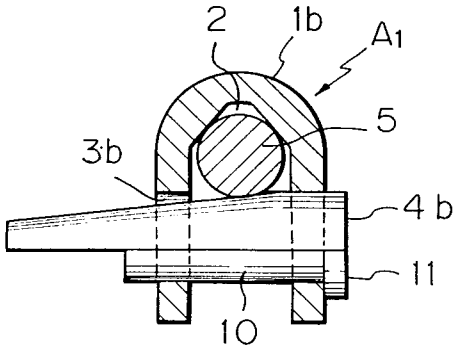
FIG. 7 is a sectional view of the joint shown in FIG. 6.
Figure 8:
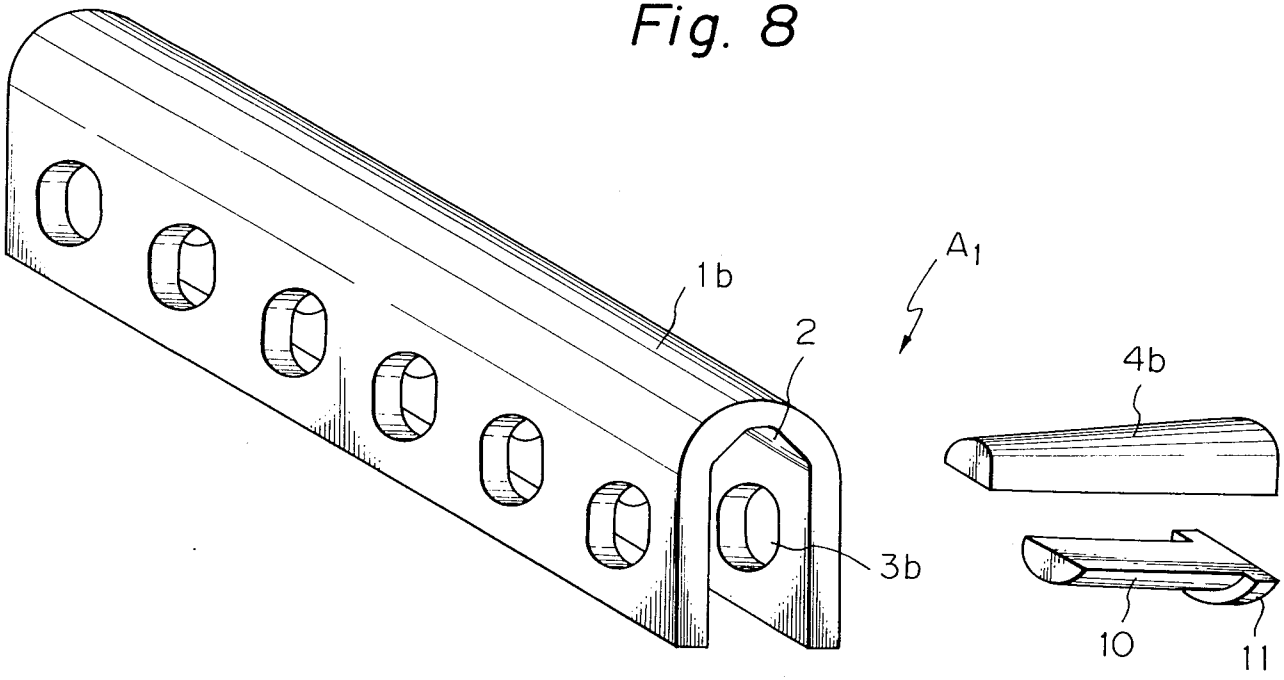
FIG. 8 is an exploded perspective view of the joint shown in FIG. 6.

FIGS. 6 to 8 show in combination a second embodiment of the present invention. In this embodiment, a joint main body 1*b* is a member having an inverted U-shaped cross section. This joint main body 1*b* is formed by bending a rectangular steel plate having an appropriate length into a U-shaped configuration, and providing a plurality of vertically elongated oval wedge bores 3*b* in each of the free end edges of both side walls of the joint main body 1*b* in such a manner that the wedge bores 3*b* are arrayed at an appropriate regular spacing, along the main body 1*b* the wedge bores 3*b* in one side wall being aligned with those in the other side wall. A wedge 4*b* is formed in such a manner that the upper portion thereof has a convex circular cross section and is gradually reduced in diameter toward the distal end thereof and the bottom thereof is a flat surface. A wedge guide member 10 is formed by splitting a bar with a circular cross section into two halves. A retaining collar 11 is provided at one end of the wedge guide member 10. The other reference numerals in these figures respectively denote the same portions or members shown in FIGS. 1 to 3.

In operation, as shown in FIG. 6, the respective connecting end portions of the reinforcing bars 5 and 6 are disposed close to each other so as to define a straight line, therebetween and the joint $A_1$ is fitted on these reinforcing bars 5 and 6 as illustrated. Then, each of the wedge guide members 10 is inserted into the lower portion of each of the wedge bores 3*b* respectively provided in the joint main body 1*b* in such a manner that the retaining collar 11 of each of the wedge guide member 10 abuts against the outer surface of one side wall of the joint main body 1*b*. Thereafter, the wedge 4*b* each of the wedges is press-fitted into the upper portion of each wedge bore 3*b* respectively along the upper surface of the associated wedge guide member 10. Consequently, the reinforcing bars 5 and 6 are pressed against the V-shaped inner surface 2 of the joint main body 1*b* at the left and right halves, respectively, of the joint main body 1*b*, and they are thereby clamped strongly in a manner similar to that in the first embodiment.

When, in this embodiment, reinforcing bars 5*a* and 6*a* such as those shown in FIGS. 4 and 5 are connected together in place of the above-described plain reinforcing bars 5 and 6, the joint also operates in a manner similar to the one above.

The joint according to the present invention offers the following prominent advantages.

(1) Since the inner surface of a curved portion of the joint main body is formed as to have a V-shaped cross section, when the connecting end portion of a reinforcing bar which is to be connected to another reinforcing bar is fitted into said curved portion and a wedge is press-fitted into a wedge bore provided in the joint main body, the reinforcing bar is pressed against the V-shaped inner surface of the curved portion of the joint main body in such a manner that it is brought into two point-contact with both slanting side surfaces of the V-shaped inner surface and bites into the V-shaped inner surface to increase the area of contact, thereby causing an increased frictional force to be obtained between the reinforcing bar and the joint main body, and thus suppressing the occurrence of the undesirable phenomenon wherein the reinforcing bar comes out of the joint main body, which has heretofore been often experienced. Thus, it is possible to connect reinforcing bars strongly and reliably at all times, which means that the present invention advantageously improves the degree of safety.

(2) Even when the reinforcing bar employed is relatively thin, it bites into the V-shaped inner surface of the joint main body and therefore even such reinforcing bars can be retained with an increased restraining force and are thereby connected together rigidly. Thus, the present invention is advantageous in practical use.

(3) Even in the case of a reinforcing bar such as that shown in FIGS. 4 and 5, since the reinforcing bar bites into the V-shaped inner surface of a curved portion of the joint main body, despite the projections provided on the outer surface thereof, the joint main body can provide a stable force for restraining the reinforcing bar. Thus, the present invention exhibits great flexibility.

(4) The joint according to the present invention has a simplified structure and can be produced at a reduced cost, so that the present invention can readily be carried out.

We claim:

1. A joint for connecting a pair of reinforcing bars together end-to-end, said joint comprising:

a joint main body having a generally U-shaped cross section defined by a pair of side walls extending parallel to and spaced from one another, and a generally outwardly curved wall extending between said pair of side walls, each of said side walls having a plurality of wedge bores extending therethrough, said plurality of wedge bores spaced from one another respectively along each of said side walls in the direction in which said side walls extend parallel to one another along the length of the main body, each of said wedge bores extending through one of said pair of side walls being aligned with a respective one of said wedge bores extending through the other of said pair of side walls thereby defining a plurality of pairs of aligned wedge bores;

said curved wall having an inner V-shaped surface defined by a pair of substantially flat surfaces extending between the surfaces of said side walls that face each other and against which end portions of said pair of reinforcing members abut;

a respective wedge extending through each of said pairs of aligned wedge bores, each said respective wedge contacting a respective said end portion of said pairs of reinforcing bars for urging said end portion against said inner V-shaped surface whereby said end portions are clamped in two-point contact against said substantially flat surfaces of said inner V-shaped surface by said respective wedges; and a respective rigid bar-shaped wedge guide member extending through each of said pairs of aligned wedge bores, each said wedge guide member bearing against a surface of a respective said wedge at a location thereon that is spaced from the location on said wedge at which said wedge contacts said respective end portion of a said reinforcing rod, said respective wedge guide members for guiding said wedges through said pairs of aligned wedge bores respectively.

2. A joint as claimed in claim 1, wherein each of said wedge guide members is insertable through said pair of aligned wedge bores and has a semi-annular collar extending around an end thereof for engaging with one of said side walls around a periphery of the wedge bore that said wedge guide member extends through.

* * * * *